US005307847A

United States Patent [19]

Pavenick et al.

[11] Patent Number: 5,307,847

[45] Date of Patent: May 3, 1994

[54] APPLICATOR FOR FLUID PRODUCTS

[76] Inventors: Stanford Pavenick, 141 E. 56 St. Apt. 2K, New York, N.Y. 10022-2722; Donald Garofalow, 16 Highland Rd., Montvale, N.J. 07645

[21] Appl. No.: 950,481

[22] Filed: Sep. 24, 1992

[51] Int. Cl.[5] ..... A45D 40/26

[52] U.S. Cl. ..... 141/20.5; 141/24; 401/127; 401/119

[58] Field of Search ..... 141/20.5, 21, 22, 23, 141/24, 25, 319, 320, 321, 322; 401/119, 126, 127, 129, 130

[56] References Cited

U.S. PATENT DOCUMENTS

| | | | |
|---|---|---|---|
| 131,255 | 8/1872 | Day | 141/321 |
| 1,770,576 | 7/1930 | Leather | 141/321 |
| 2,168,179 | 8/1939 | Tobey | 401/126 |
| 2,736,050 | 2/1956 | Lee | 401/127 |
| 2,833,318 | 5/1958 | Obarski | 141/321 |
| 2,926.374 | 3/1960 | Adler | 401/119 |
| 3,369,854 | 2/1968 | Ferris . | |
| 3,820,576 | 6/1974 | Torrent | 141/24 |
| 4,376,591 | 3/1983 | Proffer | 401/127 |
| 4,690,579 | 9/1987 | Tuckman | 401/127 |
| 4,841,996 | 6/1989 | Gueret | 132/320 |
| 4,854,759 | 8/1989 | Morane et al. | 401/119 |
| 4,917,520 | 4/1990 | Reid | 401/127 |
| 4,974,980 | 12/1990 | Gueret | 401/119 |

FOREIGN PATENT DOCUMENTS 3618046 3/1987 Fed. Rep. of Germany .

*Primary Examiner*—Ernest G. Cusick

*Attorney, Agent, or Firm*—Lerner, David, Littenberg, Krumholz & Mentlik

[57] ABSTRACT

An applicator for fluid products includes a bottle enclosed by a cap having a partition defining in the cap an enclosed chamber. The partition includes an aperture which forms a passage between the enclosed chamber in the cap and the interior of the bottle. Rotating the cap for assembly to the bottle will place this passage in an unoccluded condition. As the bottle is inverted or shaken prior to use, the fluid contents of the bottle will travel through the passage and into the enclosed chamber in the cap. As the cap is rotated for removal from the bottle, a valve element will occlude the passage, trapping the fluid in the cap. Squeezing the cap to deform the sidewalls will force the fluid through a narrow bore in a supply stem leading to a dispensing tip. The restricted passage in the supply stem will enable the fluid to be supplied to the dispensing tip in a controlled fashion, thereby enabling the fluid to be applied to a surface for an extended period of time without having to reimmerse the dispensing tip in the fluid product in the bottle.

20 Claims, 4 Drawing Sheets

APPLICATOR FOR FLUID PRODUCTS

FIELD OF THE INVENTION

The present invention relates to devices for applying fluid products contained in a bottle and, more particularly, to an applicator which permits extended application of the fluid product to a surface without having to continually insert the applicator in the bottle to replenish it with the fluid product.

BACKGROUND OF THE INVENTION

Many commercially available fluid products require application by the end user in a controlled fashion. These include, for example, touch-up paint for vehicles, brush-on adhesives, topical medications, shoe polish, liquid cosmetics and the like. These products typically come in bottles or other containers having applicator devices for dispensing and applying the fluids in their intended fashion.

Perhaps the most widely used of these products is nail polish. Nail polish ordinarily comes in a bottle having a cap which includes an applicator brush. As the brush is dipped into the bottle it is coated with an excess of polish. By wiping the brush across the lip of the bottle, the excess polish can be removed from the brush, leaving an amount which can be applied to a nail in a manageable fashion.

One of the most annoying problems in applying nail polish and other similar products is the need to continually dip the applicator in the bottle. That is, since conventional applicators are only able to hold and apply a limited amount of these products at a time, the applicator constantly must be replenished with product by dipping it in the bottle. Not only does this process make the process of applying nail polish messy, but it also lengthens the application time considerably.

Considerable attempts have been made to overcome these negative aspects of applying fluid products, and particularly nail polish, in a controlled fashion. Thus, prior art devices are extant which seek to eliminate the need to continually dip the nail polish applicator in the bottle in order to replenish the applicator with polish.

For example, Ferris, U.S. Pat. No. 3,369,854, is directed to a container and applicator for liquid products, such as nail polish. The container supports an applicator brush at an inclined position. The applicator brush includes a tubular shank having bristles at one end and a squeeze bulb at the other end. Squeezing the bulb with the bristles immersed in the liquid draws the liquid upward into an enlarged recess. Thereafter, as the bulb is squeezed the liquid is forced outwardly onto the bristles for application. The problem with this device is that it provides little control. In other words, since the shank must be large enough in diameter to draw the liquid into the recess relatively quickly, it will permit the liquid to flow outwardly in a similarly rapid fashion. The only way of controlling this outward flow is by the difficult task of regulating the amount of pressure which is manually exerted on the squeeze bulb.

In another such device, shown in U.S. Pat. No. 3,820,576 to Torrent, a pipette applicator is connected to a flexible chamber within the bottle cap. As a plunger at the top of the bottle cap is pressed, the chamber is deformed to either draw the liquid product into the chamber or to dispense the liquid product therefrom. Since the liquid product is drawn into the chamber and discharged through the same tubular stem, this device is also difficult to control in terms of accurately dispensing the liquid product. Further, the vapor-tight seal between the chamber and the bottle would make this device impractical for use with liquid products including solvents, such as nail polish, paints and adhesives. That is, since the vapor-tight seal would prevent solvents within the bottle from reaching the chamber, any residue of the liquid product within the chamber would quickly dry out and harden, hampering any further use of the device.

In U.S. Pat. No. 4,841,996 to Gueret, liquid product within a bottle is drawn upwardly by capillary action through the bristles of an applicator brush and into a hollow reservoir which surrounds an upper portion of the applicator brush. During application, a continuous amount of the liquid product is supplied to the applicator brush from the reservoir. Not only is this device difficult and costly to manufacture due to its complex configuration and its many components, but it only marginally extends the application time before having to reimmerse the brush in the liquid product in the bottle due to the limited capacity of the reservoir.

Morane et al., U.S. Pat. No. 4,854,759, is directed to yet another device for applying a liquid product, and particularly for applying nail polish. In this device, the applicator brush is connected to one end of a rod which is slidably mounted in a hollow sheath secured to the bottle cap. As the bottle is inverted, the rod slides toward the cap, withdrawing a major portion of the brush into the sheath, and the interior of the sheath fills with the liquid product through inlet apertures. When the bottle is returned to its normal upright position, gravity causes the rod to move downward until an enlarged end of the rod closes the open end of the sheath, thereby trapping the liquid product within the sheath. The device is then used to apply polish to a nail in a conventional fashion. The applicator brush can be replenished with polish when it runs dry by pressing the brush against a surface, such as a nail, thereby displacing the rod upwardly in the sheath so that the polish can drain from within the sheath onto the brush. The flow of polish to the applicator brush is stopped by lifting the brush from the nail to again close the open end of the sheath. There are many significant drawbacks associated with the structure and operation of this device which make the device totally impractical for use as an applicator. One such drawback is the reliance on gravity to seal the open end of the sheath. Thus, the presence of a foreign particle at the sheath outlet or the improper manipulation of the applicator may result in leakage of the liquid product from the sheath outlet and possibly even from the sheath inlet. Further, since it is difficult to regulate the amount by which the rod is displaced upwardly in the sheath, the amount of liquid product flowing onto the applicator brush will be similarly difficult to control. In addition, the relatively large size of the sheath and the relative ease with which the applicator brush can be moved upwardly within the sheath make this applicator device cumbersome and difficult to use.

There therefore exists a need for an applicator which can be replenished with a fluid product in a controlled fashion so that the product can be applied for extended lengths of time without having to continually immerse the applicator in the bottle containing the fluid product. Preferably, such applicator will have a simple construction which can be manufactured easily and inexpensively. Even more preferably, such applicator will look like and be used in much the same manner as conventional applicators such as to be readily accepted by the general public.

SUMMARY OF THE INVENTION

These needs have now been addressed by the invention of an applicator for a fluid product which dispenses the fluid product onto a dispensing tip in a controllable manner so that the product can be applied to a substrate for extended lengths of time without having to continually dip the dispensing tip into a bottle containing the fluid product. In accordance with one embodiment of the invention, the applicator consists of a bottle and a cap having an enclosed chamber. The cap includes a passageway by which the fluid in the bottle can enter the chamber in the cap, and valve means for controlling the flow of the fluid product through the passageway. Dispensing means are provided for dispensing the fluid product onto a surface, the dispensing means including a stem which is connected at one end to the cap and which has a dispensing tip disposed at its free end. Outlet means extend through the stem and define an outlet passage between the chamber and the dispensing tip.

The applicator may further include operating means for forcing the fluid product through the outlet passage to the dispensing tip. Preferably, the operating means includes control means for increasing the pressure in the chamber so that the fluid product will be forced through the outlet passage to the dispensing tip. In a highly preferred embodiment, the cap will be formed with flexible side walls. The control means can then be provided by the flexible side walls which merely have to be depressed in order to increase the pressure in the chamber.

The applicator may further include applying means connected to the dispensing tip at the free end of the stem for applying the fluid product to a surface. The applying means may be in the form of a brush, a sponge, or any other implement which is particularly suited to the particular product being applied.

In another embodiment, the valve means may include a valve element moveable with respect to the cap between a first position in which the valve element occludes the passageway and a second position in which the valve element does not occlude the passageway. Preferred applicators in accordance with this embodiment may have actuating means for moving the valve element between the first and second positions. The actuating means may include means for moving the valve element to the first position to occlude the passageway as the cap is rotated in a first direction for removal from the bottle, and means for moving the valve element to the second position in which the passageway is not occluded as the cap is rotated in a second direction for connection to the bottle.

Preferred applicators in accordance with the present invention have the outward appearance of conventional applicators, such as nail polish bottles. Moreover, the preferred applicators hereof are used in substantially the same way as conventional applicators, and therefore will be used without difficulty by those accustomed to conventional applicators. However, by merely exerting a slight pressure on the side walls of the applicator cap, these devices permit fluid products to be applied to surfaces over extended periods of time without the messy and time-consuming step of having to repeatedly dip the applicator into the fluid product in a bottle. Thus, the applicator of the present invention enables fluid products to be applied more rapidly and more neatly, thereby removing a major drawback to these application processes.

BRIEF DESCRIPTION OF THE DRAWINGS

A more complete appreciation of the subject matter of the present invention and the various advantages thereof can be realized by reference to the following detailed description, in which reference is made to the accompanying drawings in which.

DETAILED DESCRIPTION OF THE PREFERRED EMBODIMENTS

Figure 1:
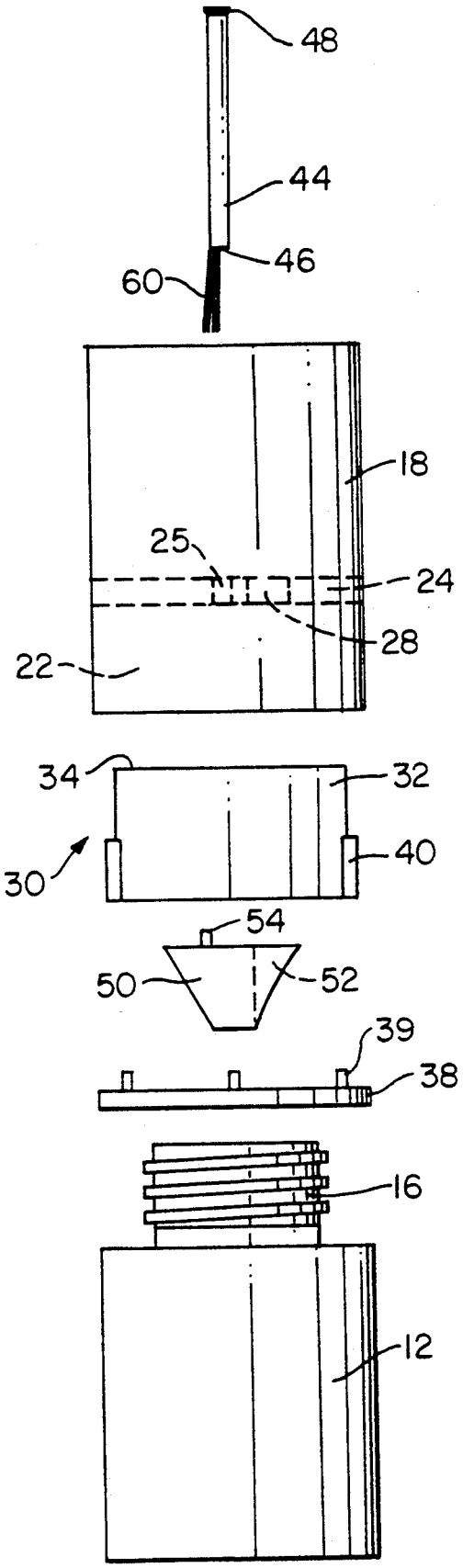
FIG. 1 is an exploded view of the applicator in accordance with the present invention.
Figure 4:
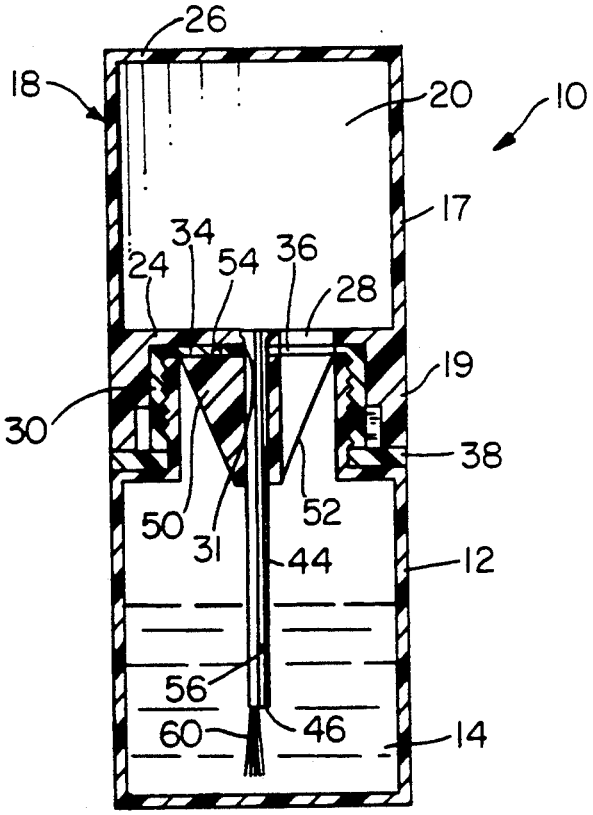
FIG. 4 is an axial cross-sectional view of a bottle provided with an applicator in accordance with the present invention.

Referring to FIGS. 1 and 4, there is illustrated an applicator 10 in accordance with the present invention. Applicator 10 includes a conventional bottle 12 for retaining a fluid product 14. Preferably, bottle 12 is formed from a transparent or translucent material, such as glass, so that the color and volume of product 14 can be viewed through the bottle. The applicator 10 can be used to apply a broad range of products where it is desired to apply those products to a substrate in a controlled fashion. Such uses may include, for example, the application of touch-up paint to automobiles and other vehicles, the controlled application of adhesives to surfaces, the application of liquid polish to shoes, etc. In the description which follows, however, the product 14 is nail polish, and the present invention is described in connection with the application of nail polish to finger nails.

The open end of bottle 12 includes a neck 16 which is externally threaded in a conventional fashion for assembly to cap 18. As will be appreciated from the description below, cap 18 is preferably formed from a material which can be deformed by the manual application of pressure, but which is sufficiently elastic that it will return to its original configuration once the pressure has been removed. Such material may include, for example, polyethylene, polypropylene, and similar materials. Cap 18 only has to deform slightly. To facilitate this deformation, the cap side walls may be thinned in upper portions 17 to increase their flexibility, but not so much as to reduce their strength significantly.

The interior of cap 18 is divided into two compartments 20 and 22 by a partition 24 which may be formed integrally with cap 18. An end member 26 seals the top of cap 18 such that compartment 20 comprises an enclosed chamber. Communication between compartments 20 and 22 of cap 18 is provided by an inlet aperture 28 in partition 24.

Seated within compartment 22 of cap 18 is a rotatable valve member 30 consisting of a cylindrical skirt portion 32 which is internally threaded for mating engagement with the externally threaded neck 16 of bottle 12 when cap and bottle 12 are in assembled position. At one end, valve member 30 includes an end wall 34 formed with an aperture 36 which is similar in size to inlet aperture 28. Valve member 30 is assembled in compartment 22 so that, in a first position of valve member 30 with respect to cap 18 shown in FIG. 2, aperture 36 will be aligned with inlet aperture 28 in partition 24 so that the passageway between compartments 20 and 22 is open; and in a second position of valve member 30 with respect to cap 18 shown in FIG. 3, end wall 34 will occlude inlet aperture 28, thereby closing the passageway between compartments 20 and 22. A retaining ring 38 may be secured to cap 18, such as by snap-fit prongs 39 or screws (not shown), to hold valve member 30 in assembled position within compartment 22 of the cap.

Valve member 30 includes three ribs 40 which project outwardly in radial directions from the outer circumference of skirt portion 32 and which are separated from one another by equal angular distances. Ribs 40 are intended to cooperate with three ribs 42 which project radially inward from the lower portions 19 of the cap side walls and which are spaced from one another by the same angular distances as are ribs 40. The cooperation of ribs 40 and 42 limits the amount by which valve member 30 may rotate with respect to cap 18 and thus defines the first and second positions of valve member 30 with respect to cap 18.

The use of three ribs 40 and three ribs 42 is merely exemplary. Any number of ribs 40 and 42 which will limit the movement of valve member 30 with respect to cap 18 may be used. For instance, the movement of valve member 30 may be limited by a single rib 40 on valve member 30 which travels between two ribs 42 on cap 18, or by a pair of ribs 40 on valve member 30 which travel on either side of a single rib 42 on cap 18. Moreover, other conventional means may be used to limit the amount by which valve member 30 may rotate with respect to cap 18.

A stem 44, force fit through bores 25 and 31 centrally disposed in partition 24 and valve member 30, respectively, extends downwardly therefrom such that the free end 46 of the stem will be located in the interior of bottle 12 when cap 18 is in assembled position on the bottle. One end of stem 44 may include a flange 48 to locate stem 44 with respect to partition 24 and thus facilitate the assembly process. A collar, such as frustoconically shaped collar 50, may be assembled over stem 44 to structurally reinforce stem 44 and stabilize same from excessive bending. Collar 50 includes an offset axial bore 52 which is locked into alignment with aperture 36 by a locating pin 54 extending from collar 50 and into an aperture (not shown) in end wall 34 of valve member 30, thereby preventing these elements from rotating with respect to one another. Optionally, collar 50 may be formed integrally with valve member 30, thereby obviating the need for locating pin 54.

Figure 6:
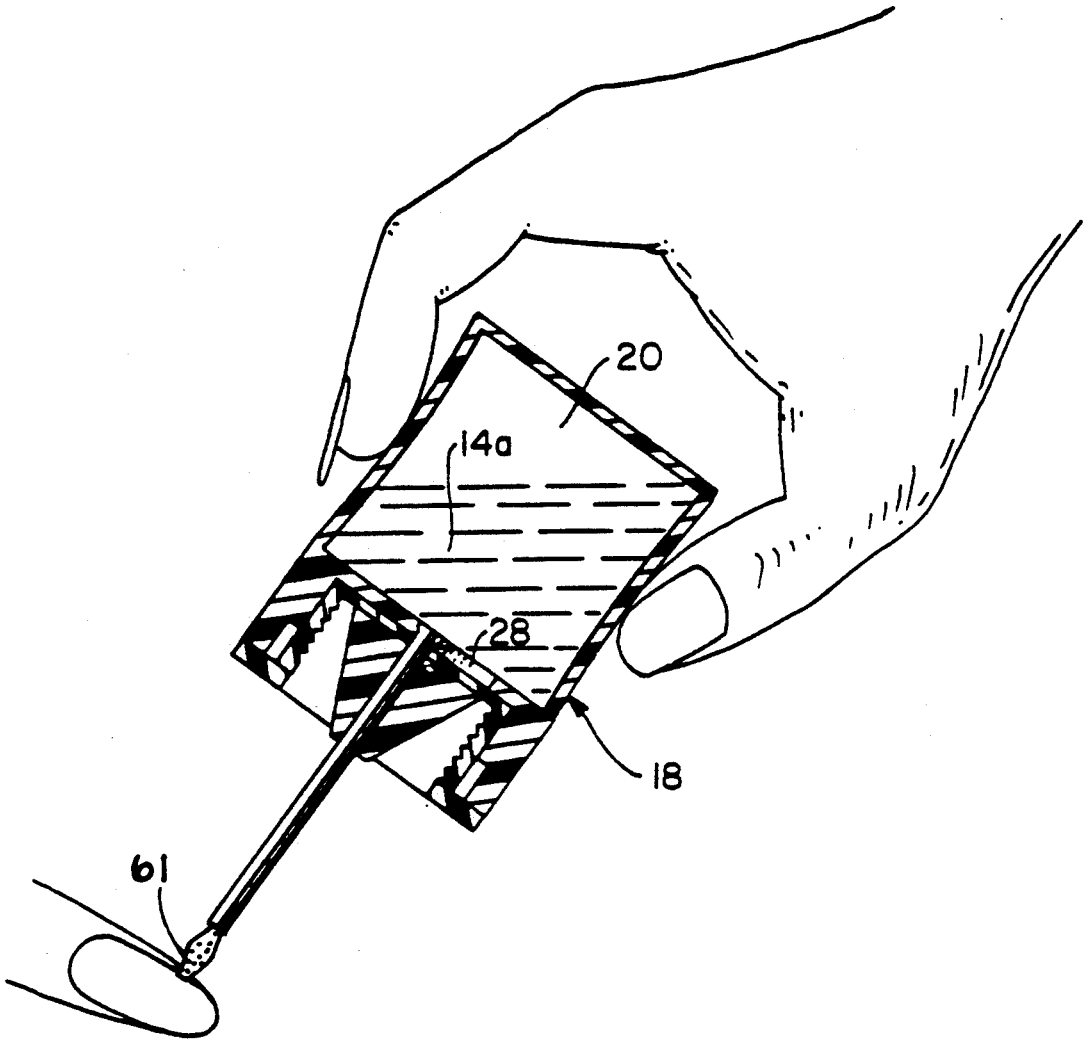
FIG. 6 is a partial cross-sectional view showing the application of nail polish using an alternate embodiment of the applicator of the present invention.

Stem 44 includes an axial bore 56 extending through the entire length thereof to define a passageway from compartment 20 to the free end 46 of the stem. The diameter of bore 56 will generally be selected depending upon the viscosity of the product 14 being applied by applicator 10. At its free end 46, stem 44 may include a brush 60, such as in conventional nail polish applicators, for applying product 14 to a surface. Rather than a brush 60, the free end 46 of stem 44 may be provided with a sponge (FIG. 6) or other type of applicator device depending upon the particular product being applied and its method of application. Where the free end 46 of stem 44 does not include a brush 60 or similar device, applicator 10 may be used to merely dispense a fluid product in a controlled fashion, much like an eye dropper.

Figure 2:
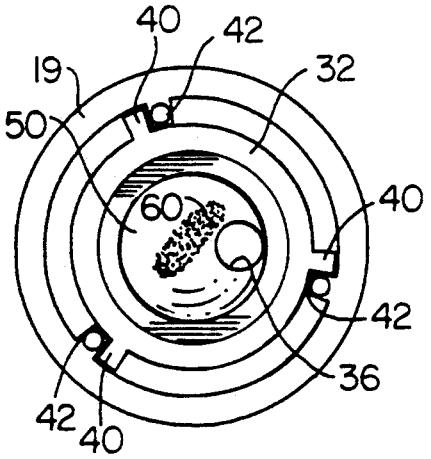
FIG. 2 is a bottom view of the applicator cap showing the inlet to the cap in an open condition.
Figure 3:
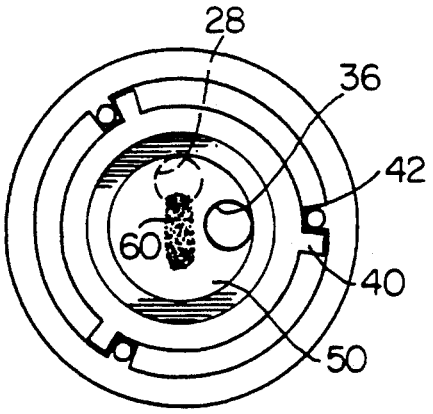
FIG. 3 is a bottom view of the applicator cap showing the inlet to the cap in an occluded condition.

The operation of applicator 10 to apply nail polish in a controlled fashion to fingernails can best be understood by reference to FIGS. 2–5. Initially, applicator 10 will be arranged as shown in FIG. 4, with cap 18 securely tightened on bottle 12. In this state, substantially all of fluid product 14 will be in bottle 12 and valve member 30 will be positioned such that apertures 36 and 28 are in alignment with one another, as illustrated in FIG. 2. Before applying fluid product 14, in this case nail polish, the user inverts applicator 10, perhaps shaking it to mix the nail polish to a homogeneous consistency. As the applicator 10 is inverted and shaken, a portion **14*a* of nail polish 14 will pass through apertures 36 and 28 and into compartment 20 in cap 18. After an appropriate period of shaking to thoroughly homogenize the nail polish, applicator 10 is returned to an upright orientation and cap 18 is unscrewed from bottle 12 by rotating the cap, typically in a counterclockwise direction with respect to the bottle. During the initial stages of this rotation, valve member 30 will remain stationary with respect to bottle 12 while cap 18 rotates freely. As cap 18 rotates with respect to valve member 30, aperture 28 in partition 24 will move out of alignment with aperture 36 until aperture 28 is entirely occluded by partition 24, as illustrated in FIG. 3, trapping portion 14*a* of the nail polish in compartment 20. At this point, each of inwardly extending ribs 42 on cap 18 will engage an outwardly extending rib 40 on valve member 30 so that further rotation of cap 18 in the counterclockwise direction will result in the simultaneous rotation of valve member 30 in the same direction, whereupon cap 18 will become disassembled from neck 16 of bottle 12. Although some of portion 14*a* of the nail polish may flow through apertures 36 and 28 from compartment 20 back into bottle 12 as the bottle is uprighted and cap 18 is removed, apertures 36 and 28 are of sufficiently small size that this return flow is slow and an adequate volume of nail polish is trapped in compartment 20**.

Figure 5:
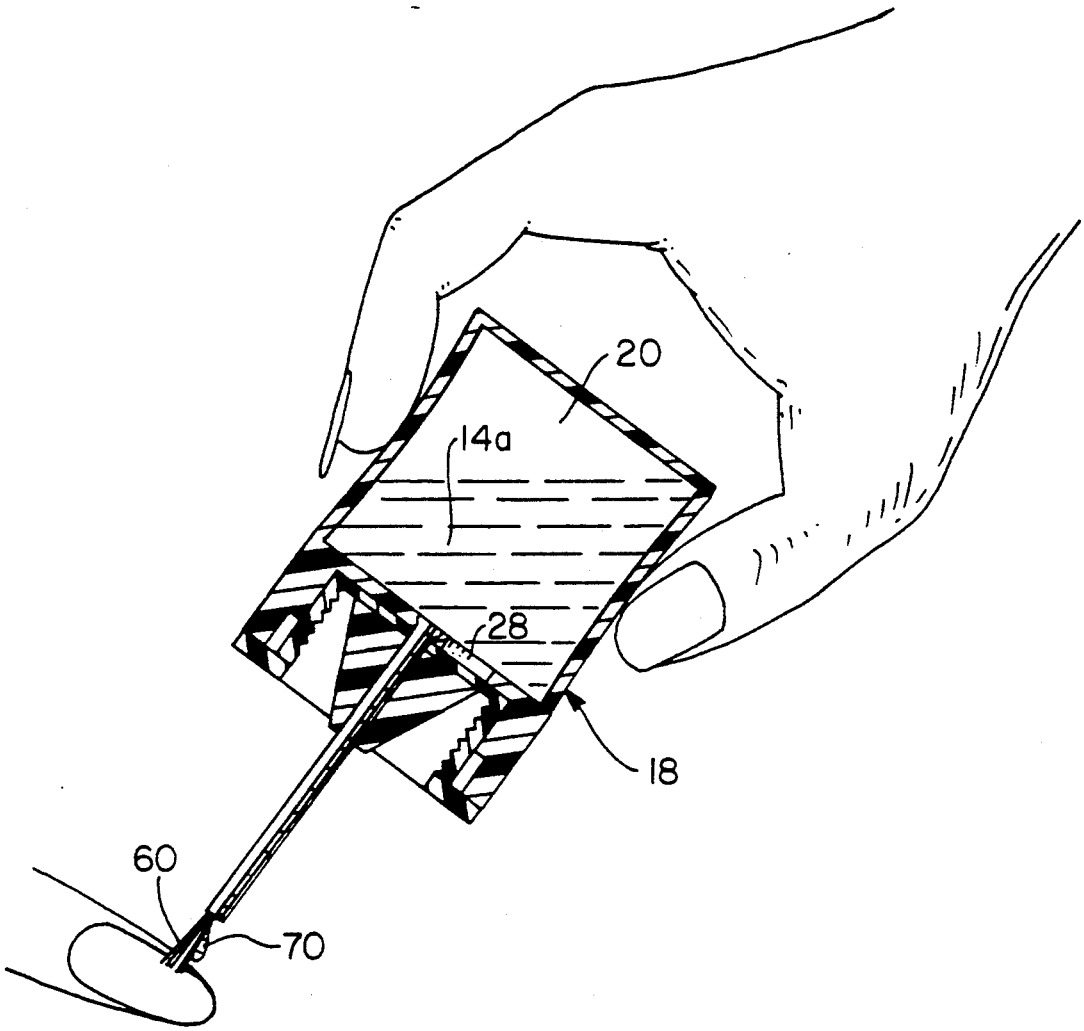
FIG. 5 is a partial cross-sectional view showing the application of nail polish using the applicator of the present invention.

The user can now begin to apply nail polish to a nail in a conventional fashion, as shown in FIG. 5. In this initial phase of application, the user grasps cap 18 and manipulates same to spread the nail polish from brush 60 onto the nail. When the nail polish has been depleted from brush 60, the user can reload the brush 60 with nail polish by squeezing the cap 18 to deflect the upper portions 17 of the side walls. Since inlet aperture 28 is occluded, the inward deflection of side wall portions 17 will cause a slight pressure increase within compartment 20, thereby forcing a small amount of nail polish **14*a* down through bore 56 toward brush 60. By properly selecting the diameter of bore 56, the amount of nail polish travelling through bore 56 can be adjusted to a manageable rate. As little as a single drop 70 of nail polish can be fed to brush 60** so that no more nail polish than is required for a single nail will be fed to the brush at any one time.

Rather than squeezing on cap 18 to deflect the side walls, other arrangements may be used to increase the pressure within compartment 20 and thus force nail polish **14*a* outward through bore 56. For example, end member 26 of cap 18 may be fitted with a spring biased plunger which can easily be depressed by the forefinger of the user while holding cap 18**.

The portion 14*a* of nail polish 14 in compartment 20 will ordinarily be sufficient to coat all of the fingernails on both hands and, most likely, all of the toenails on both feet so that the user can complete the entire nail polishing procedure without having to reimmerse the applicator brush 60 in the bottle 12. This greatly increases the speed of application while reducing the mess which is commonly associated with continually having to replenish the applicator brush with nail polish by reimmersing the brush in the bottle.

As with conventional nail polish applicators, once the polishing procedure has been completed, the cap 18 is returned to the bottle 12 and screwed into place on neck 16 by rotating the cap in a clockwise direction with respect to the bottle. At some point during this rotation, typically after the threaded portions of valve member 30 and neck 16 have been fully engaged, cap 18 will rotate relative to valve member 30, returning applicator 10 to the condition shown in FIG. 2 with aperture 28 in partition 24 aligned with aperture 36. When apertures 28 and 36 are aligned, each of the inwardly extending ribs 42 on cap 18 will engage an outwardly extending rib 40 on valve member 30, thereby preventing further relative movement of cap 18 with respect to valve member 30. As a result of the alignment of apertures 28 and 36, any of the portion of nail polish 14*a* remaining in compartment 20 will be able to drain through the aligned apertures back into bottle 12. Further, solvents in the nail polish will be able to drift upwardly from bottle 12 into compartment 20. The solvent pressure in compartment 20 will thus prevent any nail polish residue which may remain in compartment 20 from drying out.

Although the invention herein has been described with reference to particular embodiments, it is to be understood that these embodiments are merely illustrative of the principals and applications of the present invention. It is therefore to be understood that numerous modifications may be made to the illustrative embodiments and that other arrangements may be devised without departing from the spirit and scope of the present invention as set forth in the appended claims.

We claim:

1. An applicator for a fluid product, comprising a bottle defining a reservoir for said fluid product and having an open end, a cap for enclosing said open end of said bottle, said cap defining an enclosed chamber, dispensing means for dispensing said fluid product onto a surface, said dispensing means including a stem connected at one end in fluid communication with said chamber and having a dispensing tip disposed at a free end, outlet means extending through said stem for defining an outlet passage between said chamber and said dispensing tip, passage means remote from said stem for defining a passageway between said chamber and said reservoir, and valve means disposed in said cap for controlling the flow of said fluid product through said passageway.

2. The applicator as claimed in claim 1, further comprising operating means for forcing said fluid product through said outlet passage to said dispensing tip.

3. The applicator as claimed in claim 2, wherein said operating means includes control means for increasing the pressure in said chamber from an initial pressure to a pressure greater than said initial pressure.

4. The applicator as claimed in claim 3, wherein said cap includes flexible side walls and wherein said control means includes said flexible side walls of said cap.

5. The applicator as claimed in claim wherein said bottle includes a first threaded portion and said valve means includes a second threaded portion engageable with said first threaded portion for assembling said cap to said bottle.

6. The applicator as claimed in claim further comprising applying means connected to said dispensing tip for applying said fluid product to said surface.

7. The applicator as claimed in claim 6, wherein said applying means comprises a brush.

8. The applicator as claimed in claim 6, wherein said applying means comprises a sponge.

9. The applicator as claimed in claim wherein said valve means comprises a valve element movable with respect to said cap between a first position in which said valve element occludes said passageway and a second position in which said valve element does not occlude said passageway.

10. The applicator as claimed in claim 9, further comprising actuating means for moving said valve element between said first and second positions.

11. The applicator as claimed 10, wherein said actuating means includes means for moving said valve element to said first position to occlude said passageway as said cap is rotated in a first direction for removal from said bottle, said actuating means further including means for moving said valve element to said second position to not occlude said passageway as said cap is rotated in a second direction for connection to said bottle.

12. The applicator as claimed in claim further comprising applying means connected to said dispensing tip for applying said fluid product to said surface.

13. The applicator as claimed in claim 9, further comprising operating means for forcing said fluid product through said outlet passage to said dispensing tip.

14. The applicator as claimed in claim 13, wherein said operating means includes control means for increasing the pressure in said pressure from an initial pressure to a pressure greater than said initial pressure.

15. The applicator as claimed in claim 14, wherein said cap includes flexible side walls and wherein said control means includes said flexible side walls of said cap.

16. The applicator as claimed in claim 14, further comprising applying means connected to said dispensing tip for applying said fluid product to said surface.

17. An applicator package, comprising a bottle defining a reservoir and having an open end, a fluid product disposed in said reservoir, a cap for enclosing said open end of said bottle, said cap defining an enclosed chamber, dispensing means for dispensing said fluid product onto a surface, said dispensing means including a stem connected at one end in fluid communication with said chamber and having a dispensing tip disposed at a free end, outlet means extending through said stem for defining an outlet passage between said chamber and said dispensing tip, passage means remote from said stem for defining a passageway between said chamber and said reservoir, and valve means disposed in said cap for controlling the flow of said fluid product through said passageway.

18. The package as claimed in claim 17, wherein said valve means comprises a valve element movable with respect to said cap between a first position in which said valve element occludes said passageway and a second position in which said valve element does not occlude said passageway.

19. The package as claimed in claim 18, further comprising actuating means for moving said valve element between said first and second positions, said actuating means including means for moving said valve element to said first position to occlude said passageway as said cap is rotated in a first direction for removal from said bottle, said actuating means further including means for moving said valve element to said second position to not occlude said passageway as said cap is rotated in a second direction for connection to said bottle.

20. The package as claimed in claim 19, wherein said passageway includes an aperture between said chamber and said reservoir, whereby said fluid product can flow from said reservoir to said chamber upon inversion of said package from an upright position.

* * * * *

UNITED STATES PATENT AND TRADEMARK OFFICE

CERTIFICATE OF CORRECTION

PATENT NO. : 5,307,847

DATED : May 3, 1994

INVENTOR(S) : STANDFORD PAVENICK, DONALD GAROFALOW

It is certified that error appears in the above-indentified patent and that said Letters Patent is hereby corrected as shown below:

Column 4, line 19, delete "and."

Column 4, line 22, "invention." should read --invention; and --.

Column 5, line 2, "cap and " should read -- cap 18 and --.

Column 8, line 6, " claim wherein" should read --claim 1, wherein --.

Column 8, line 11, "claim further" should read --claim 1 further --.

Column 8, line 36, "claim further" should read --claim 11 further --.

Signed and Sealed this

Thirtieth Day of August, 1994

*Attest:*

*Attesting Officer*

Bruce Lehman

BRUCE LEHMAN

*Commissioner of Patents and Trademarks*